United States Patent [19]

Fernandez

[11] B 3,994,052

[45] Nov. 30, 1976

[54] METHOD AND APPARATUS FOR TEXTURING YARN

[75] Inventor: Miguel A. Fernandez, Greenville County, S.C.

[73] Assignee: Phillips Petroleum Company, Bartlesville, Okla.

[22] Filed: Aug. 14, 1974

[21] Appl. No.: 497,292

[44] Published under the second Trial Voluntary Protest Program on February 3, 1976 as document No. B 497,292.

[52] U.S. Cl. ..... 28/1.6; 28/72.14

[51] Int. Cl.[2] ..... D02G 1/12

[58] Field of Search ..... 28/1.6, 1.7, 72.14

[56] References Cited

UNITED STATES PATENTS

| | | | |
|---|---|---|---|
| 3,778,872 | 12/1973 | Newton | 28/1.6 |
| 3,811,263 | 5/1974 | Newton | 28/1.6 UX |

*Primary Examiner*—Robert R. Mackey

[57] ABSTRACT

A wad of textured yarn is removed from texturing apparatus by passing the wad into the inlet of an elongated tube having one or more openings intermediate the two ends thereof. In normal operation, a fluid is passed through the tube toward the inlet end to cool the yarn and assist in breaking up the wad. During startup, fluid is passed through the tube in the opposite direction to aspirate the yarn through the tube.

2 Claims, 2 Drawing Figures

METHOD AND APPARATUS FOR TEXTURING YARN

Synthetic fibers are commonly produced by extruding molten polymer through a spinneret. In order to produce yarns which have properties approximating those of wool or other natural materials, it is common practice to subject the extrudate to a texturing process. This can be accomplished by a variety of procedures known in the art, such as stuffer-box crimping, false twisting, and fluid jet texturing. One particularly effective procedure involves contacting the fiber with a high velocity fluid stream in a turbulent zone at an elevated temperature. The turbulence imparted to the fiber produces crimps which give the fiber a textured appearance.

As set forth in U.S. Pat. No. 3,778,872, it has recently been found that improved texturing can be accomplished by passing yarn from a turbulent zone through a chamber which contains a plurality of discrete members, such as balls. These members exert a force on the yarn to produce a wad which extends through the chamber. The yarn wad can then be passed into the inlet end of an elongated tube which is provided with one or more openings intermediate the ends thereof. A fluid is passed through the tube toward the inlet end with a substantial quantity of the fluid being vented through the openings. The fluid thus exerts a retarding force which tends to prevent breakup of the yarn wad until the yarn has been cooled. The cooled textured yarn is withdrawn from the outlet end of the tube. During startup, fluid is introduced into the tube downstream of the openings and in a direction so as to flow through the tube toward the outlet end.

While the foregoing procedure has been found to be quite effective in texturing yarn, some time is lost during startup while the yarn wad travels through the tube from the texturing apparatus to the openings. Although this time is of relatively short duration, the cumulative effect is large in commercial operations wherein the apparatus must be strung from time to time as breaks or other malfunctions occur.

In accordance with this invention, it has been found that startup time in texturing apparatus of the type described can be reduced by introducing a fluid stream into the yarn removal tube at a location upstream of the openings and in a direction toward the discharge end of the tube. This fluid stream serves to aspirate the yarn through the tube and thereby saves the time previously required for the yarn wad to move through the tube to the openings.

Figure 1:
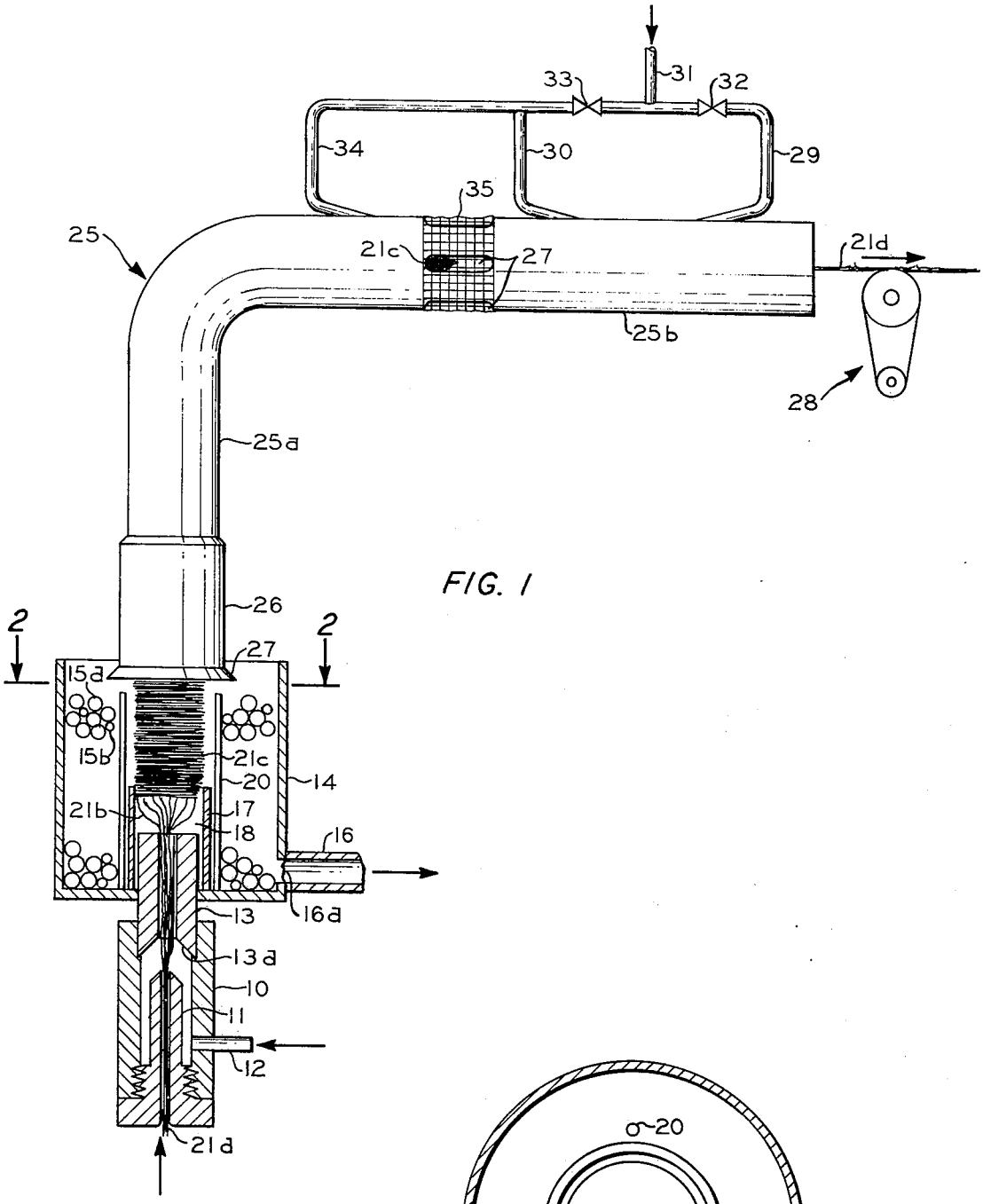
FIG. 1 illustrates an embodiment of the apparatus of this invention.

Referring now to the drawing in detail and to FIG. 1 in particular, there is shown a housing 10 which has a hollow needle 11 positioned therein. A conduit 12 communicates with housing 10 to introduce a fluid, such as steam or air, at an elevated temperature. A tube 13 is secured to housing 10 so that the opening therethrough forms an extension of the passage through needle 11. The inlet end of the tube 13 is tapered to provide a seat 13*a* adjacent the end of needle 11. The angle of seat 13*a* can be the same as the angle of the tapered end of needle 11, but this is not necessary.

Figure 2:
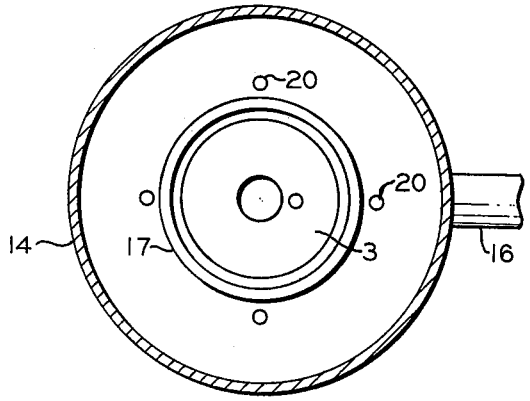
FIG. 2 is a view taken along line 2—2 in FIG. 1.

A hollow chamber 14 is secured to the tube 13 to enclose the upper end of the tube. A large number of relatively small balls 15*a* and 15*b* are disposed within chamber 14. Chamber 14 can be provided with an outlet conduit 16 which is connected to a drain or to a source of reduced pressure, not shown. A screen 16*a* is positioned across conduit 16 to retain balls 15*a* and 15*b* within chamber 14. A sleeve 17 encloses tube 13 within chamber 14 and extends upwardly above the tube to form a zone 18 of high turbulence. Four rods 20 surround sleeve 17 and extend upwardly through chamber 14. As illustrated in FIG. 2, these rods are 90° apart.

In the operation of the apparatus, one or more filaments 21 are inserted through the interior passage of needle 11 into tube 13. These filaments can be delivered to the apparatus by any suitable feed means, not shown in normal startup operation, the filaments are threaded completely through the apparatus thus far described. Fluid is introduced through conduit 12 and flows upwardly through tube 13 into zone 18. The fluid so introduced surrounds needle 11 to elevate the temperature of the incoming filaments. The velocity of the introduced fluid is sufficiently high to produce considerable turbulence in the passage defined by zone 18. This turbulence imparts crimp to the filaments to produce textured yarn 21b. The yarn passes upwardly to form an elongated generally cylindrical wad 21c in the region between rods 20. The wad in this region is engaged by balls 15*a* and 15*b* which exert a restraining force. Rods 20 confine the yarn wad to the central region of chamber 14. It is important that rods 20 be spaced a sufficient distance from one another that balls 15*a* and 15*b* are free to move therebetween to exert a force on the yarn wad. While four rods have been found to be satisfactory to retain the wad, more can be used if desired. In some operations, three rods spaced 120° apart will provide the desired support. The rods 20 prevent the yarn wad from collapsing or bending under the surface of the balls.

As previously mentioned, the velocity and temperature of the fluid introduced through conduit 12 are such as to impart the desired degree of crimp in the yarn in zone 18. If desired, an external heater can be employed to assist in elevating the temperature of the filaments in needle 11. The texturing fluid escapes from zone 18 and the yarn wad through the surrounding balls. When steam is employed as the texturing fluid, it may be desirable to provide vent conduit 16 to remove vapor and any condensate which may be formed. Balls 15*a* and 15*b* can be formed of metal, glass or any other material which is inert to the yarn at the temperature encountered. The balls are advantageously of spherical configuration, but this is not essential to the operation of the invention. As illustrated, balls 15*a* are larger than balls 15*b* to provide better packing. However, the balls can all be the same size. The height of the balls in chamber 14 should be sufficient to permit the yarn to be cooled by a substantial amount before removal from the chamber. In general, the upper surface of the balls should be at least one diameter of balls 15*a* below the tops of rods 20.

An elongated tube 23 is positioned above chamber 14. In the illustrated embodiment of this invention, tube 25 comprises a generally vertical inlet section 25*a* and a generally horizontal outlet section 25*b*. A second tube 26 encloses the lower end of inlet section 25*a* of tube 25. Tube 26 is of greater diameter than tube 25 so as to be free to slide vertically on tube 25. The lower end of tube 25 can be provided with an outwardly extending flange on which the top edge of tube 26 rests.

This retains tube 26 immediately above rods 20 in the position shown. The lower end of tube 26 can be provided with a flared inlet 27 so that the yarn wad 21c moves readily into the tube. Tube section 25b is provided with one or more elongated slots 27. Yarn is removed from the second end of tube section 25b by means of a suitable takeup device 28 and passed to a storage area or to other processing equipment, not shown. A screen 35 can be placed over slots 27 to prevent yarn from blowing out the slots.

A first conduit 29 communicates with tube section 25b in a direction so that fluid passed through conduit 29 enters tube 25 and flows toward the inlet end thereof. A second conduit 30 communicates with tube section 25b in a direction so that fluid flowing through this conduit enters tube 25 and flows toward the outlet end thereof. Conduits 29 and 30 are connected to a common inlet conduit 31, and valves 32 and 33 are disposed in respective conduits 29 and 30. A third conduit 34 communicates with tube section 25b upstream of openings 27 and in a direction so that fluid flowing through conduit 34 enters tube 25 and flows toward the outlet end thereof. Conduit 34 communicates with inlet conduit 31 through valve 33.

In the normal operation of the texturing apparatus, valve 32 is opened and valve 33 is closed so that fluid, such as air, entering through conduit 31 flows through conduit 29 and through tube 25 toward the inlet end. A substantial quantity of this fluid is vented through openings 27, with the remainder passing through tube section 25a to the end of the tube. The outlet end of tube 25 is open. This results in some atmospheric air being drawn into the outlet end of the tube by aspiration. The yarn wad 21c rises through the inlet section of the tube to a region in the vicinity of openings 27. At this point, the yarn wad tends to be broken up so that the individual textured strands 21d are passed through the remainder of tube 25. The flow of air through tube 25 serves to cool the yarn to assist in imparting a permanent crimp. In order to accomplish this result, it is desirable that openings 27 be positioned at a spaced location from inlet 26. This provides greater cooling before the yarn wad is broken up.

During startup, yarn is first threaded through tubes 11 and 13. The operator can then lift tube 26 so that the end of the yarn can be inserted into the lower first end of tube 25. At this time, valve 32 is closed and valve 33 is opened so that fluid introduced through conduit 31 flows through conduits 30 and 34. The fluid stream introduced into tube 25 from conduit 34 serves to aspirate the end of the yarn through tube section 25a to the region of openings 27. The fluid stream introduced into tube 25 from conduit 30 serves to aspirate the end of the yarn through tube section 25b to the outlet end of tube 25. In the absence of conduit 34, it is necessary to wait in the startup procedure until the yarn wad is forced upwardly to the region of openings 27. This frequently takes about 15 seconds.

In the illustrated embodiment of this invention, tube 25 is provided with a 90° bend. Openings 27 can be located upstream or downstream from the bend. The bend facilitates the removal of the textured yarn to suitable takeup equipment. However, it is not necessary that the tube be provided with any bend at all. The tube should be constructed of a material having smooth walls so that there is minimum resistance exerted on the yarn. A lining of Teflon can be employed to advantantage for this purpose.

A specific example of typical operating conditions of the texturing apparatus is set forth in U.S. Pat. No. 3,778,872, the disclosure of which is herein incorporated by reference. In one specific embodiment of this invention, tube 25 has a diameter of about 1 inch. Conduits 29, 30 and 34 are ¼-inch tubing. Air is supplied through conduit 31 at a pressure of 20 psig.

Although this invention has been described in conjunction with a presently preferred embodiment, it obviously is not limited thereto.

What is claimed is:

1. In a process for texturing filaments by subjecting the filaments to external crimping forces at an elevated temperature and thereby establishing an elongated wad of crimped yarn, and wherein yarn is removed from the wad, by passing the yarn wad into the first end of an elongated tube which has an opening therein intermediate the two ends of the tube and a first fluid stream is passed through the tube toward said opening to impinge on the yarn wad at the opening, during normal operation of the filament texturing process; the method of starting up the process which comprises simultaneously passing second and third fluid streams through the tube, the second fluid stream being passed through said tube toward the second end of the tube from an inlet region spaced between the first end of the tube and said opening, and the third fluid stream being passed through said tube toward the second end of the tube from an inlet region spaced between said opening and the second end of the tube, said second and third fluid streams being deactivated during normal filament operation, and said first fluid stream being deactivated during the starting up of the process.

2. In filament texturing apparatus comprising means to subject filaments to mechanical forces to form an elongated wad of crimped yarn, an elongated tube positioned so that the wad enters the first end thereof, said tube being provided with an opening intermediate the first end and a second end thereof, and first conduit means communicating with said tube between said opening and the second end of the tube to convey a first fluid stream selectively into said tube in a direction so that said first fluid stream passes through the tube toward said opening during normal operation of the filament texturing apparatus; apparatus for use in startup comprising second conduit means communicating with said tube between the first end and said opening to convey a second fluid stream selectively into said tube in a direction so that said second fluid stream passes through the tube toward said opening, and third conduit means communicating with said tube between said opening and the second end of the tube to convey a third fluid selectively into said tube in a direction so that said third fluid stream passes through the tube toward said second end, means to simultaneously activate said second and third conduit means during startup of the filament texturing apparatus and to deactivate said second and third conduit means during normal operation of said filament texturing apparatus, and means to activate said first conduit means during normal operation of said filament texturing apparatus and to deactivate said first conduit during said startup.

* * * * *